US010708984B2

(12) United States Patent
Tanaka et al.

(10) Patent No.: US 10,708,984 B2
(45) Date of Patent: Jul. 7, 2020

(54) HEATING COIL AND HEAT TREATMENT APPARATUS

(71) Applicant: NETUREN CO., LTD., Tokyo (JP)

(72) Inventors: Yoshimasa Tanaka, Tokyo (JP); Yutaka Sugiyama, Tokyo (JP)

(73) Assignee: NETUREN CO., LTD., Tokyo (JP)

( * ) Notice: Subject to any disclaimer, the term of this patent is extended or adjusted under 35 U.S.C. 154(b) by 601 days.

(21) Appl. No.: 14/434,443

(22) PCT Filed: Oct. 11, 2013

(86) PCT No.: PCT/JP2013/006115
§ 371 (c)(1),
(2) Date: Apr. 9, 2015

(87) PCT Pub. No.: WO2014/057692
PCT Pub. Date: Apr. 17, 2014

(65) Prior Publication Data

US 2015/0296572 A1 Oct. 15, 2015

(30) Foreign Application Priority Data

Oct. 12, 2012 (JP) ..... 2012-227419

(51) Int. Cl.
*H05B 6/40* (2006.01)
*H05B 6/10* (2006.01)
(Continued)

(52) U.S. Cl.
CPC ..... *H05B 6/40* (2013.01); *H05B 6/104* (2013.01); *H05B 6/365* (2013.01); *H05B 6/42* (2013.01)

(58) Field of Classification Search
CPC . H05B 6/104; H05B 6/42; H05B 6/40; H05B 6/365
(Continued)

(56) References Cited

U.S. PATENT DOCUMENTS 2,632,840 A * 3/1953 Sorensen ..... B23K 13/02 219/612
2,715,170 A 8/1955 Sorensen
(Continued)

FOREIGN PATENT DOCUMENTS

CA 2789927 A1 8/2011
GB 616063 A 1/1949
(Continued)

OTHER PUBLICATIONS

International Search Report dated Jan. 22, 2014, issued in corresponding application No. PCT/JP2013/006115.

*Primary Examiner* — Ibrahime A Abraham
*Assistant Examiner* — John J Norton
(74) *Attorney, Agent, or Firm* — Westerman, Hattori, Daniels & Adrian, LLP

(57) ABSTRACT

In preferred embodiments, a heating coil is provided that includes at least a set of heating conductors, one of which is arranged at a side of a work and the other one is arranged at an opposite side of the work. In addition, a plurality of connecting conductors are provided to connect an end of one of the heating conductors with an end of the other heating conductor, wherein each of the heating conductors is connected with at least two connecting conductors. The connecting conductors extend from an end of each of the heating conductor in a different direction from each other. In the preferred embodiments, the heating coil has a simple structure that enables an even heat treatment to a work in a width direction.

17 Claims, 5 Drawing Sheets

(51) Int. Cl.
*H05B 6/36* (2006.01)
*H05B 6/42* (2006.01)

(58) Field of Classification Search
USPC ..... 219/672, 639
See application file for complete search history.

(56) References Cited

U.S. PATENT DOCUMENTS

| | | | | | |
|---|---|---|---|---|---|
| 3,848,107 | A | * | 11/1974 | Lewis | H05B 6/40 219/637 |
| 5,345,065 | A | | 9/1994 | Reinke et al. | |
| 5,495,094 | A | * | 2/1996 | Rowan | H05B 6/36 219/645 |
| 5,550,353 | A | * | 8/1996 | Peysakhovich | B22D 11/1213 219/647 |
| 5,837,976 | A | * | 11/1998 | Loveless | H05B 6/04 219/645 |
| 5,844,213 | A | * | 12/1998 | Peysakhovich | B22D 11/1213 219/647 |
| 6,963,056 | B1 | * | 11/2005 | Peysakhovich | H05B 6/104 219/645 |
| 2012/0312805 | A1 | | 12/2012 | Umetsu et al. | |

FOREIGN PATENT DOCUMENTS

| | | | | |
|---|---|---|---|---|
| JP | 6-220526 | A | | 8/1994 |
| JP | 08-165516 | A | | 6/1996 |
| JP | 2000204413 | A | * | 7/2000 |
| JP | 2001-329313 | A | | 11/2001 |
| JP | 2002-270357 | A | | 9/2002 |

* cited by examiner

[Fig. 1]
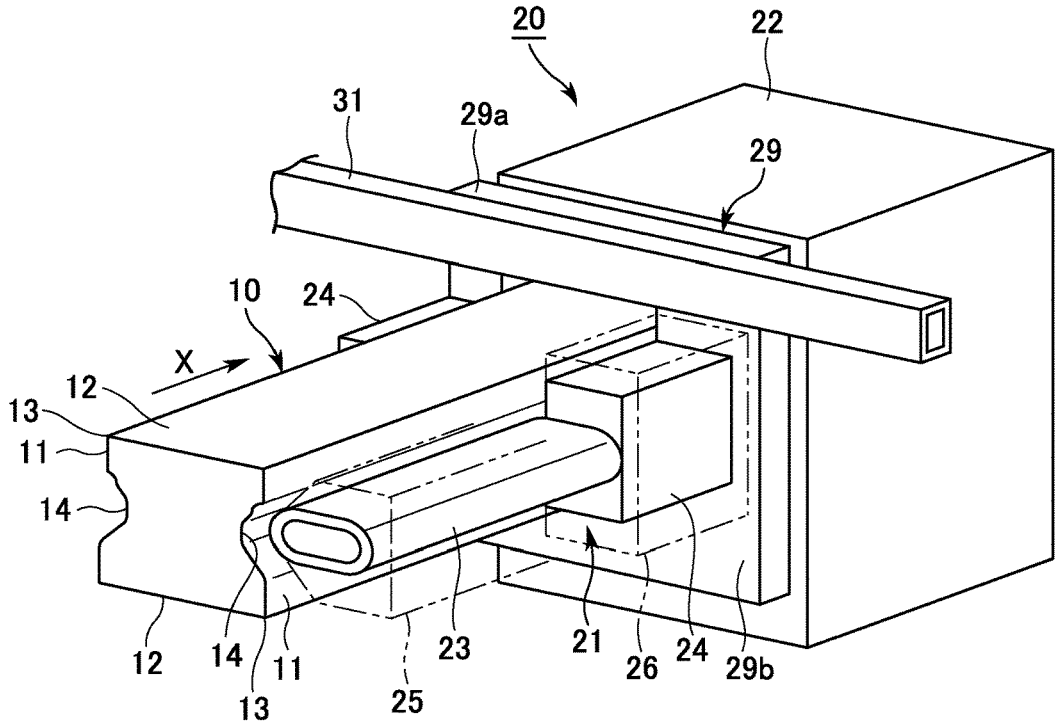
[Fig. 2]
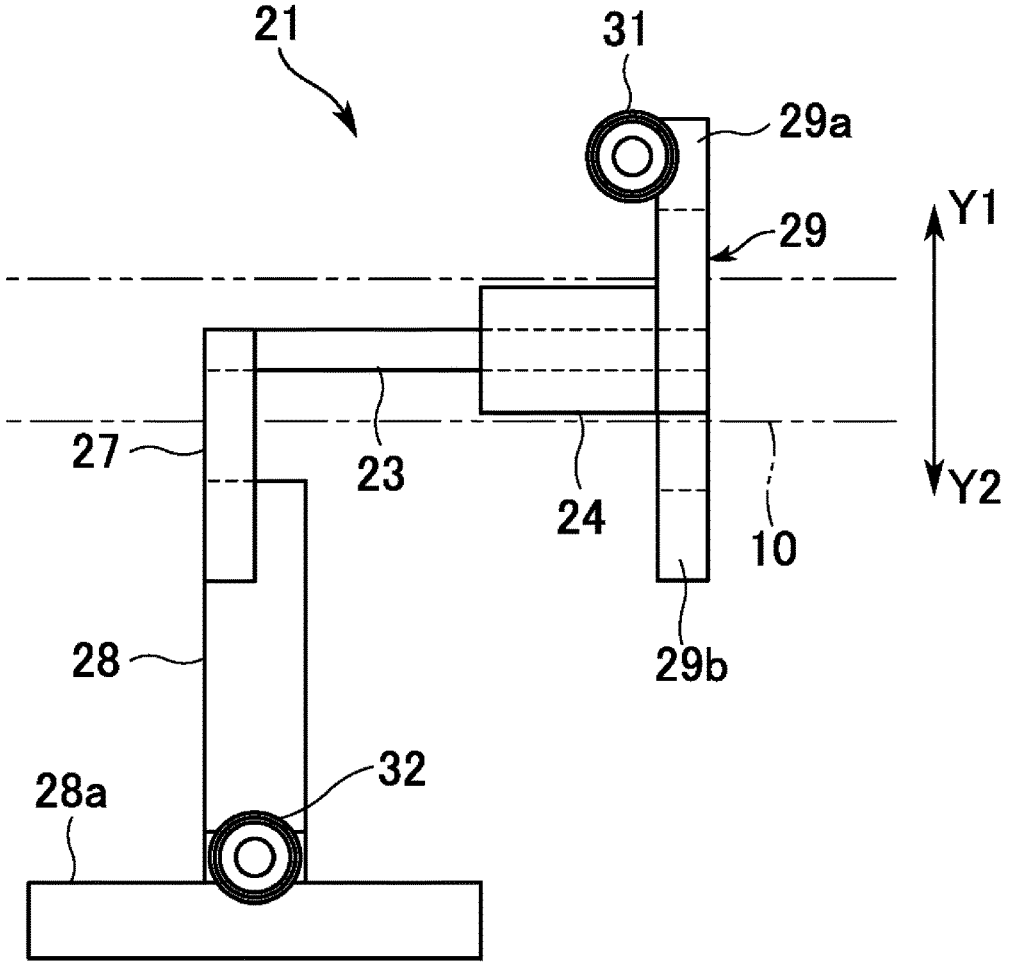

[Fig. 3]
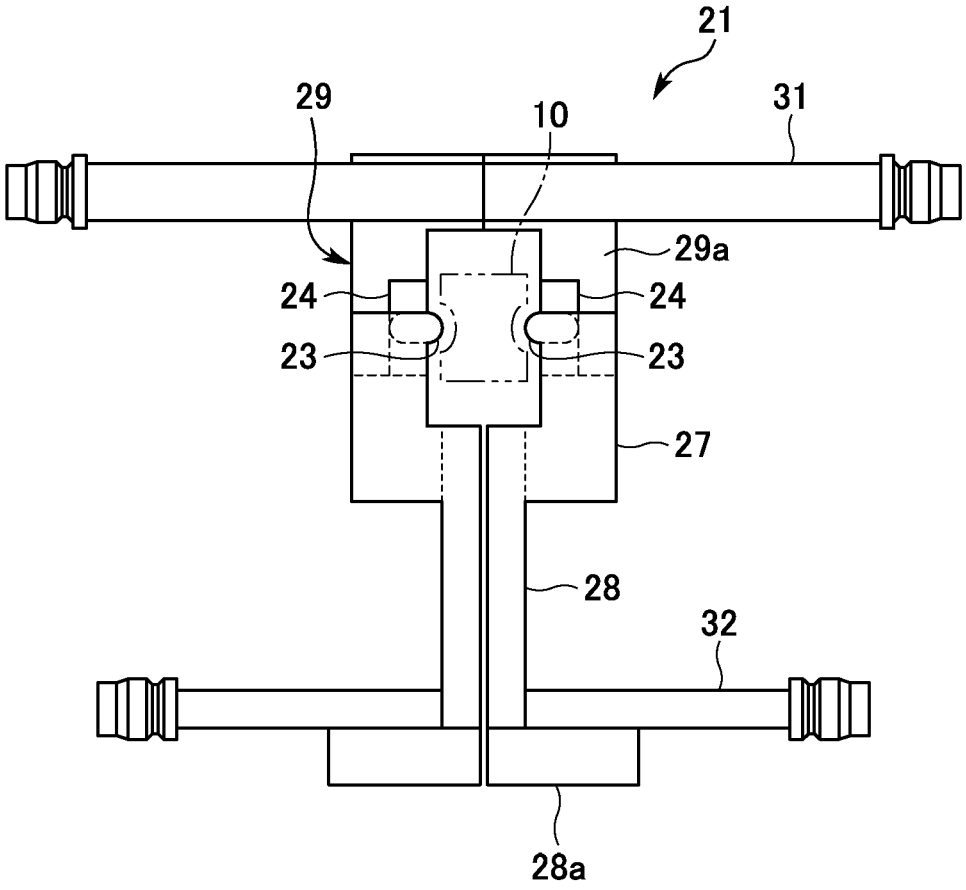

[Fig. 4]
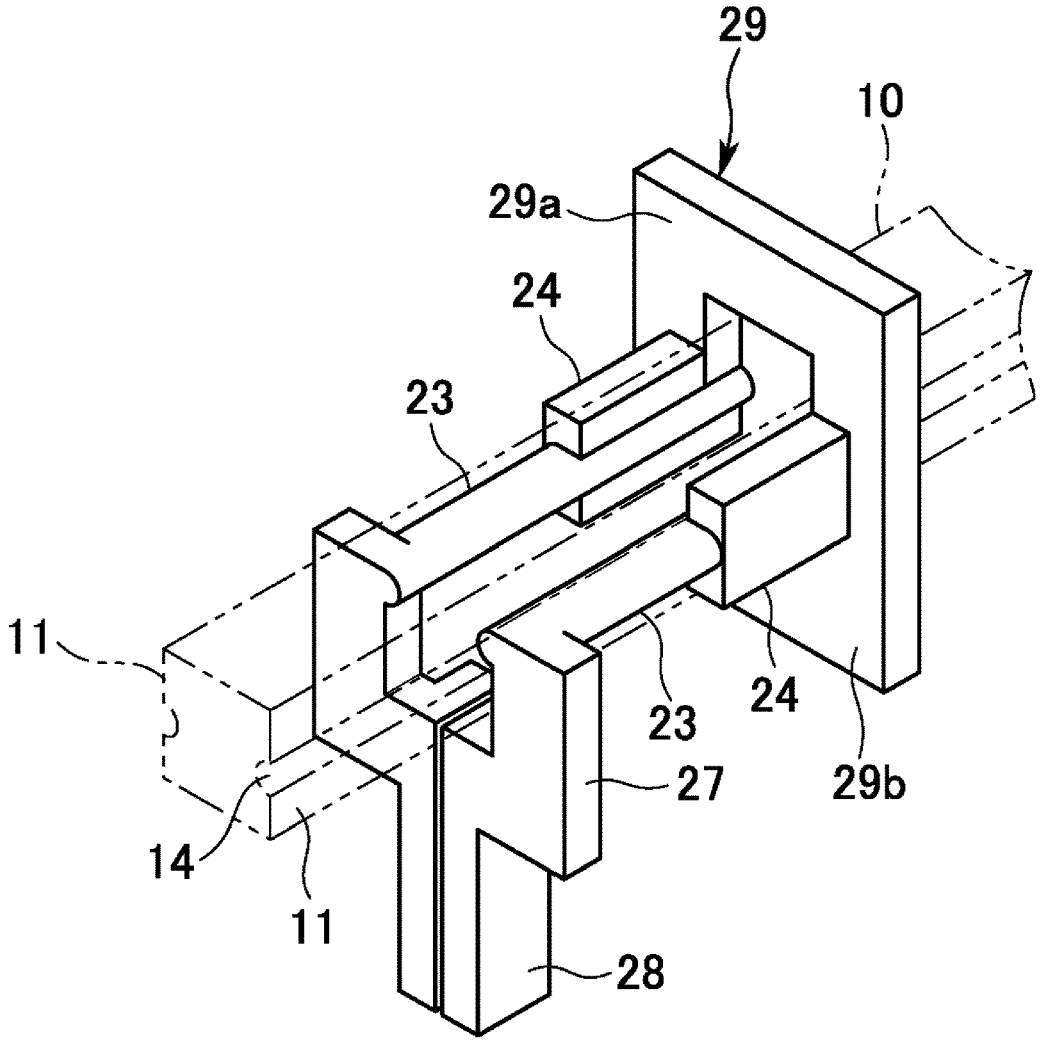
[Fig. 5]
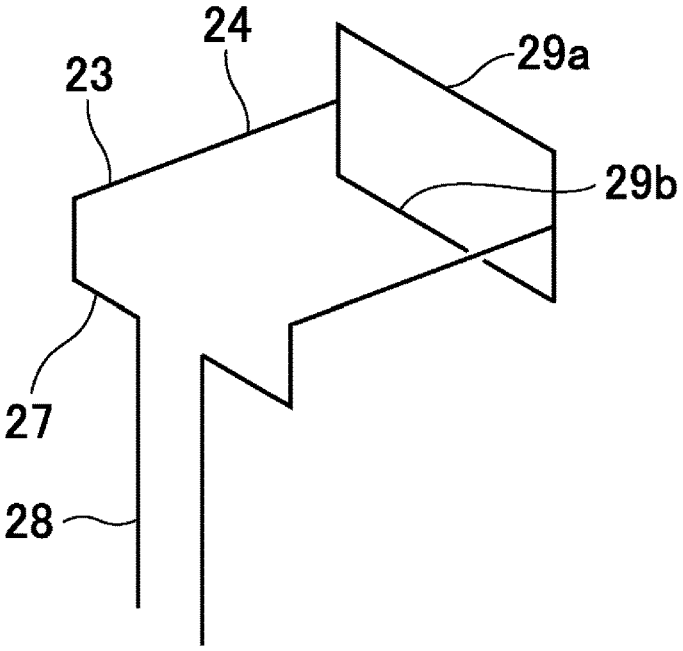

[Fig. 6]
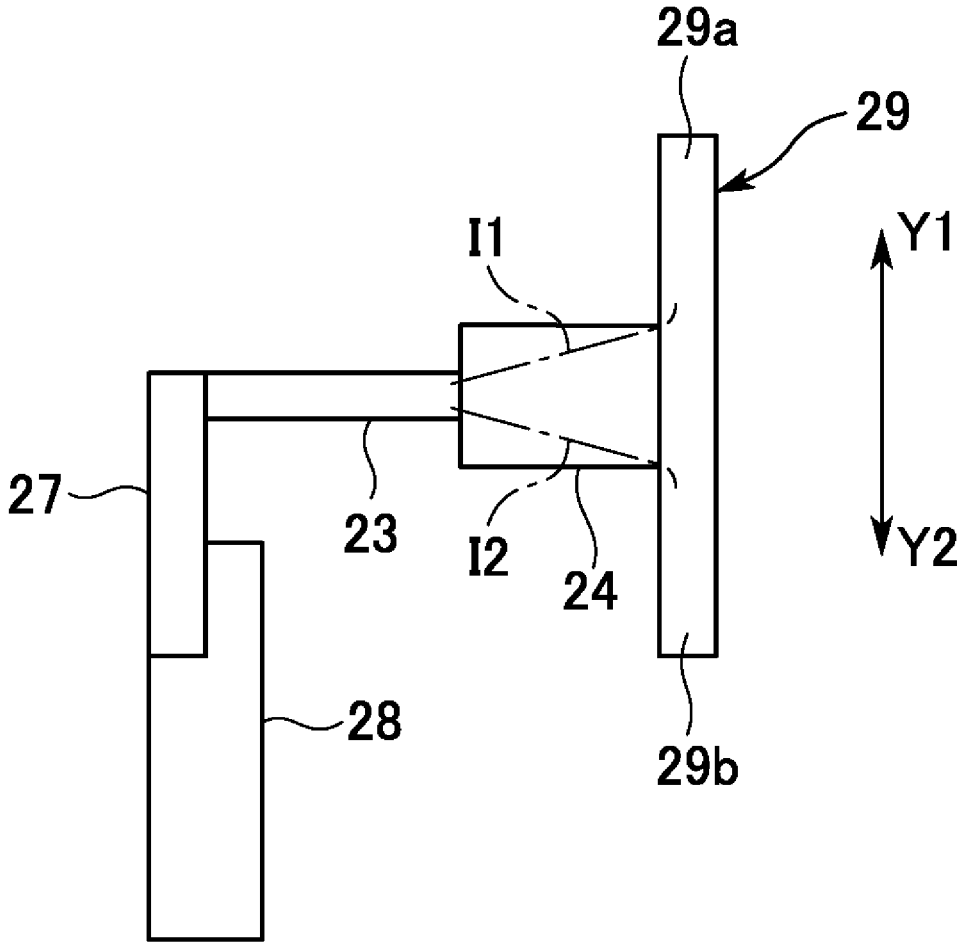
[Fig. 7]
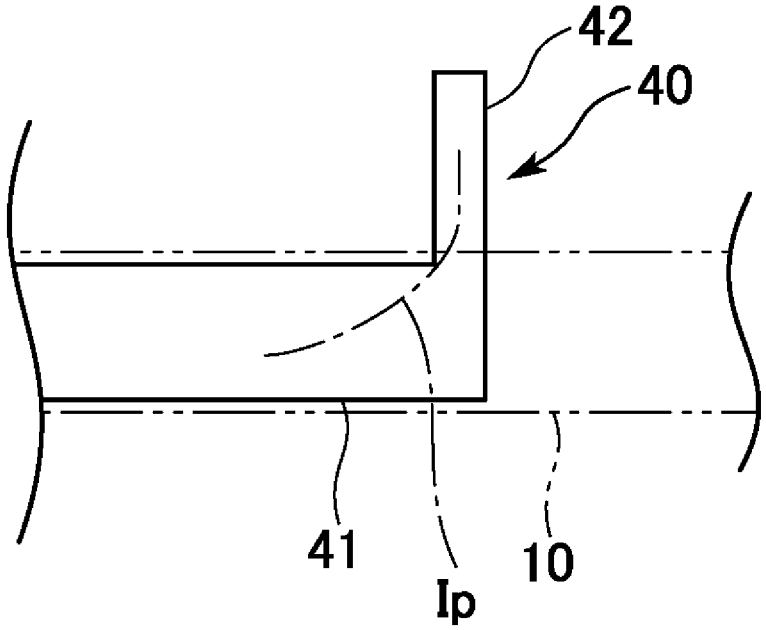

[Fig. 7]
Background Art
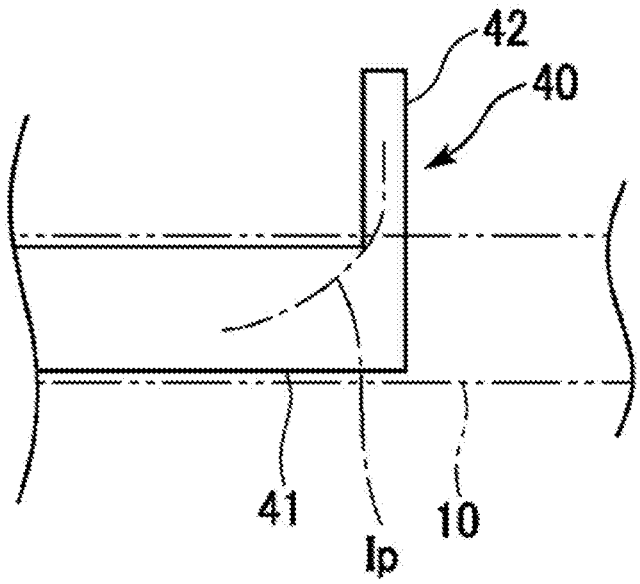

HEATING COIL AND HEAT TREATMENT APPARATUS

TECHNICAL FIELD

The present invention relates to a heating coil to perform induction heating on a plurality of sides of a work and a heat treatment apparatus with the same.

BACKGROUND ART

Conventionally, a heating coil for partially induction-heating a plurality of places at sides of a work has been proposed (see Patent Literature 1). For example, the heating coil 40 is well-known as such a kind of coil, which has a pair of heating conductors 41, one of which is arranged at a side of a work 10 and the other one is arranged at an opposite side of the work 10; and an end of heating conductors 41 is respectively connected with a connecting conductor 42, as shown in FIG. 7.

In the heating coil 40, the work 10 is arranged between the pair of heating conductors 41; the heating conductors 41 faces a part of sides of the work 10; a power source is connected with the other end of the pair of heating conductors 41; and power is fed through heating conductors 41 and the connecting conductor 42 to perform partial induction heating on respective sides of the work 10.

CITATION LIST

Patent Literature

PTL 1: JP 2002270357A

SUMMARY OF INVENTION

Technical Problem

In the conventional heating coil 40, as shown in FIG. 7, the pair of heating conductors 41 having a width corresponding to a heating side or region of the work 10 is connected with each other by a connecting conductor 42. However, since current flows along the shortest path, current is not evenly spread all the connected portion of the heating conductors 41 and the connecting conductor 42, but biased toward the inside, as shown by a chain line in FIG. 7. Accordingly, induction heating is performed more strongly along with a biased current path Ip and heat treatment is performed not evenly all the heating side of the work 10, in fact, it is newly found that the unevenness results in a poor heat treatment. Furthermore, it is observed that the wider the width is, the more noticeable the tendency is.

Accordingly, an objective of the present invention is to provide a heating coil having a simple structure to enable an even heat treatment to a work in the width direction, and to provide a heat treatment apparatus with the heating coil.

Solution to Problem

In order to achieve above objectives, a heating coil of the present invention includes:

at least a set of heating conductors, one of which is arranged at a side of a work and the other one is arranged at an opposite side of the work; and a plurality of connecting conductors to connect an end of one of the heating conductors with an end of the other heating conductor, wherein each of the heating conductors is connected with at least two connecting conductors, and the connecting conductors extend from an end of each of the heating conductor in a different direction from each other.

In this heating coil, the end of the heating conductor connected with the connecting conductor preferably faces a side of the work. In that case, it is preferable that a pair of the connecting conductors is provided to extend symmetrically from one end of respective heating conductors.

Further, at least the one set of heating conductors may partially faces the work and is arranged in parallel to each other, and at least the two connecting conductors may be symmetrically arranged about the work.

In order to achieve above objectives, a treatment apparatus of the present invention includes: the above-mentioned heating coil and a power supply connected with the other end of each of the heating conductors.

In the heat treatment apparatus, a work preferably moves at the predetermined speed in a direction during heating by the heating coil.

Advantageous Effects of Invention

According to the heating coil and heat treatment apparatus of the present invention, connecting conductors, connecting an end of heating conductors, are arranged to extend from an end of each of the heating conductor in a different direction from each other, therefore, current flow is not biased at the connected portion of respective heating conductors and the connecting conductors. As it can prevent current from intensively flowing into a part of the connected portion, induction heating can be more evenly performed at a side of the work corresponding to the connected portion.

Consequently, the present invention provides a heating coil having a simple structure to enable an even heat treatment to a work in the width direction, and to provide a heat treatment apparatus with the heating coil.

BRIEF DESCRIPTION OF DRAWINGS

FIG. 1 is a schematic perspective view showing a structure of a main section of a heat treatment apparatus according to an embodiment of the present invention.

FIG. 2 is a front view showing the heating coil in the heat treatment apparatus in FIG. 1.

FIG. 3 is a left side view showing the heating coil in FIG. 2.

FIG. 4 is a schematic perspective view showing a relation between the heating coil in FIG. 2 and the work.

FIG. 5 is a perspective view schematically showing a current path of the heating coil in FIG. 2.

FIG. 6 is a schematic front view showing a positional relation between respective conductors.

FIG. 7 is a partial side view showing an example of a heating coil in a traditional heat treatment apparatus.

DESCRIPTION OF EMBODIMENTS

Hereafter, the present invention will be fully described with reference to embodiments shown in figures.

First, FIG. 1 shows a structure of an embodiment of the heat treatment apparatus with the heating coil according to the present invention.

(Work)

As shown in FIG. 1, a work for heat treatment in the embodiment is a long member having an almost constant cross-sectional surface perpendicular to a longitudinal direction and extending in one direction. The axis of the work 10 may be arcuate or circular. In this embodiment, the work has a straight axis.

The work 10 has an almost rectangular cross-sectional surface. In the figure, left and right side portions 11 have a different shape from upper and lower faces 12, formed to be flat. The side portion 11 is adjacent to the upper and lower face 12 at a corner portion 13. The corner portion 13, connecting the side portion 11 to the upper and lower faces 12, may have any desired shape such as sharpened, rounded, beveled and grooved. At the corner portion 13, heat transfer speed is faster than the side portion 11 or the upper and lower faces 12.

The side portion 11 has a concave portion 14 separated from the corner portion 13, in this embodiment, at the center of the side portion 11 in the width direction and along the longitudinal direction. The shape of the concave portion 14 is not limited but must be more concave than both adjacent sides. In the embodiment, the concave portion 14 is provided at the side portion 11, provided at both sides of the upper and lower faces 12.

The concave portion 14 is formed at an upper side portion 11, the upper and lower faces 12, and a lower side portion 11 of the work 10, and provided in the longitudinal direction along all the work 10 in an almost constant shape.

(Heat Treatment Apparatus)

The heat treatment apparatus 20 is to perform a heat treatment like hardening to the work 10, here in this embodiment, it is to perform a hardening of surface layer of the side 11. As shown in FIG. 1, the heat treatment apparatus 20 has a heating coil 21 to perform induction heating of the side portion 11 and a cooling section 22 arranged at a downstream to blow a coolant to cool the work 10. Moreover, the heat treatment apparatus 20 also has a feeding machine (not shown) to move the work 10 to a direction X along the longitudinal direction at a predetermined constant speed.

(Heating Coil)

As shown in FIGS. 1 to 3, the heating coil 21 has a narrow width conductor 23 and a wide width conductor 24, and the narrow width conductor 23 faces concave portion 14. The wide width conductor 24 faces side portion 11 and concave portion 14. The narrow width conductor 23 and the wide width conductor 24 are connected to form a heating conductor to partially heat a side of the work 10, and arranged at both sides of the work 10.

In FIG. 2, each of the wide width conductors 24 has a length corresponding to Y1, Y2, i.e., the length of vertical direction in the figure, respectively facing the work 10, and faces the side portion 11 with a predetermined gap. Each of the narrow width conductors 23 has a shorter length than that of the wide width conductor 24 and faces the concave portion 14 with a predetermined gap.

The wide width conductor 24 is a rectangular column or blockish shape and has an almost flat surface facing the side portion 11. The surface length in a vertical direction may be slightly shorter than the length of Y1, Y2, but it is preferable to be within a range that the surface can heat whole the side portion 11.

The shape of cross section of the narrow width conductor 23 is oval and has a convex portion corresponding to the concave portion 14. The convex portion is preferably of a size to be stored in the concave portion 14.

The narrow width conductor 23 and wide width conductor 24 are parallelly arranged along the axis in a longitudinal direction of the work 10 and provided with a predetermined length in the longitudinal direction. The length in the longitudinal direction of the narrow width conductor 23 is longer than the length in the longitudinal direction of the wide width conductor 24, and the narrow width conductor 23 may be arranged to overlap with wide width conductor 24 at least partially, preferably entirely.

In FIG. 1, the narrow width conductor 23 is arranged to partially overlap with the wide width conductor 24 in the longitudinal direction.

The narrow width conductor 23 and the wide width conductor 24 may be properly structured to arrange cores 25, 26 at the portion not facing the work 10 to focus flux to the side portion 11 or the concave portion 14.

An end of respective narrow width conductors 23 are connected with end conductors 27, and respective end conductors 27 are provided with a power supply and a lead portion 28 (not shown). A plurality of connecting conductors 29 are connected with an end of respective wide width conductors 24 at the side of the work 10 to connect the wide width conductors 24 with each other so that pairs of heating conductors are formed.

A plurality of the connecting conductors 29 is separately arranged. Specifically, they are arranged to extend from the same end of the wide width conductor 24 and separate in different directions. In this embodiment, as shown in FIG. 4, the connecting conductors 29 are arranged to extend symmetrically from an end of the wide width conductor 24 about the work, i.e., in a vertical direction Y1, Y2 as shown in the figure. In this embodiment, a pair of the connecting conductors 29 is constituted of upper connecting conductor 29*a* and the lower connecting conductor 29*b*, which are respectively U-shaped and provided on an opposite surface of the wide width conductor 24 to the surface with which the narrow width conductor 23 is connected.

Here in this figure, the upper connecting conductor 29*a* and the lower connecting conductor 29*b* are integrated, however, they may be separated, furthermore, individual conductor may be connected.

The upper connecting conductor 29*a* and the lower connecting conductor 29*b* are arranged above and below the way the work 10 moves but to be separated from the work 10, and to parallelly connect an end of respective wide width conductors 24. As a whole, the connecting conductors 29 are arranged to be squarely around the work 10 in a direction it moves.

Since both ends of connecting conductors 29 are respectively connected with an end of the wide width conductors 24, the central portion of connecting conductors 29 is electrically connected with wide width conductor 24. At the connected portion, the wide width conductor 24 is crookedly connected with the connecting conductors 29, and is substantially perpendicular to the connecting conductors 29 in the axis direction. The whole connected portion of the wide width conductor 24 and the connecting conductors 29 is arranged to face the side portion 11 of the work 10.

In the heating coil 21, as shown in FIG. 5, electric power is fed from one of the lead portions 28 through the end conductor 27 to one of the narrow width conductor 23 and the wide width conductor 24 in sequence, then electric current flows parallelly through the upper connecting conductor 29*a* and the lower connecting conductor 29*b* to the other narrow width conductor 23 and the wide width conductor 24, further, through the end conductor 27 arrived at the lead portion 28.

The heating coil 21 has an inlet 31 for cooling liquid and an outlet 32 for cooling liquid. The conductors 23, 24, 27, and 29 are formed to be hollow using a member such as a copper pipe, and the conductors 24, 23, 27, and a lead 28 are communicated in this order. An end of the lead 28 is connected to a contact plate 28*a* on which the outlet 32 for cooling liquid is provided, and the outlet 32 for cooling liquid is communicated with the hollow of the lead 28 at a joint point. The connecting conductor 29 is connected with the inlet 31 for cooling liquid, i.e., the connecting conductor 29 is communicated with the inlet 31 for cooling liquid at the joint point. The inlet 31 for cooling liquid, the connecting conductor 29, the wide width conductors 24, the narrow width conductor 23, the end conductor 27, the lead 28, and the outlet 32 for cooling liquid are communicated in this order to form a coolant flow path. In the embodiment shown in FIG. 2, the connecting conductor 29 is connected with inlet 31 for cooling liquid and blocked at the middle of each of the connecting conductor 29 to form another coolant flow path. The contact plate 28*a* is connected with an end of a power supply path such as bus bar, and a power supply is connected with the other end of the power supply path such as bus bar.

In the heat treatment apparatus 20 shown in the FIG. 1, the work 10 is relatively moved to X direction along a longitudinal direction at a predetermined speed to pass the heating coil 21 and the cooling section 22 during the heat treatment apparatus 20 supplies a high-frequency power with the heating coil 21 and the cooling section 22 supplies with the coolant.

While the work 10 moves through the position of the narrow width conductor 23, the concave portion 14 of both sides of the work 10 and its vicinity are heated by induction heating. Then, while the work 10 moves through the position of the wide width conductor 24, both side portions 11 of the work 10 are entirely heated by induction heating.

The work 10 is rapidly cooled at a position immediately after passing the connecting conductor 29 of the heating coil 21 by the coolant blown from the cooling section 22, thereby hardening of a surface layer along the shape of both side portions 11 of the work 10 to complete the heat treatment. Afterward, it is possible to perform a cutting work such as a screw hole on an unhardened upper and lower face 12 of the work 10.

Operational Advantage of the Embodiment

The heat treatment apparatus 20 according to an embodiment of the present invention enables an even induction heating of a side along a longitudinal direction of a work 10 evenly moving in an X direction at a constant speed.

As shown in FIGS. 4 and 6, the connecting conductors 29 are arranged to extend from an end of the wide width conductor 24 in a different direction from each other. Accordingly, during the induction heating, current from the narrow width conductor 23 through the wide width conductor 24 to the connecting conductor 29 parallelly flows to both the upper connecting conductor 29*a* and the lower connecting conductor 29*b*.

Specifically, as shown in FIG. 6, current between the wide width conductor 24 and the connecting conductor 29 flows along the shortest paths I1, I2 oblique to the vertical direction Y1, Y2. Therefore, these shortest paths I1, I2 prevent a bias current in the wide width conductor 24, especially, in the vicinity of the connected portion of the wide width conductor 24 and the connecting conductor 29 so that the current is split into both the shortest paths I1, I2. Accordingly, the present invention prevents an uneven heating such as a one-sided bias induction heating of the work 10 in the width direction, as found in a conventional heat treatment apparatus 20, and enables a more even heating by induction heating and heat treatment on both sides of the work 10 in a width direction by the wide width conductor 24.

Especially in this embodiment, the wide width conductor 24 is formed to have a wide width face facing the work 10. Moreover, the wide width conductor 24 is quite bent to an axis direction of the wide width conductor 24 and the connecting conductor. In such the heating coil 21, a bias current is notable at a connected portion of the wide width conductor 24 and the connecting conductor 29. Accordingly, a plurality of the connecting conductors 29 are arranged to extend in a different direction from each other to effectively prevent an uneven heating of the work 10 in a width direction. Therefore, it allows improving a heat treatment quality at the side portion 11 of the work 10.

In the meantime, various modifications and alterations of the present invention may be made without departing from the scope and spirit of the invention.

For example, the above embodiment refers to the heating coil 21 having a pair of parallel heating conductors to describe an example to heat the work 10 made of a long member with a constant cross-sectional surface. However, a shape of the work is not limited to something and may not be straight; may be bent or have a curved side. In those cases, the present invention can be applied if using a heating coil, includes: a plurality of heating conductors facing a part of a side of a work W; and a plurality of connecting conductors parallelly connecting the heating conductors and arranged between the heating conductors to extend in a different direction from each other.

Further, the above embodiment shows integrated heating conductor constituted of the narrow width conductor 23 and the wide width conductor 24, however, even if a cross section of a heating conductor has a certain and unchanged shape in a longitudinal direction, it can be used as a heating coil of the present invention.

Furthermore, the above embodiment shows that the upper connecting conductor 29*a* and the lower connecting conductor 29*b* respectively protrude in a direction Y1, Y2, vertical to a longitudinal direction of the narrow width conductor 23 and the wide width conductor 24. However, not limited to the above, these portions may protrude in a different direction from the longitudinal direction.

In the above embodiment, the wide width conductor 24 is arranged to at least partially overlap with the narrow width conductor 23. However, not limited to the above, the narrow width conductor 23 and the wide width conductor 24 may be arranged at a different position in a longitudinal direction of the work 10. In this case, the narrow width conductor 23 is preferably to be arranged at a further upstream than the wide width conductor 24. This arrangement allows the whole side portion 11 to be heated by the wide width conductor 24 after the concave portion 14 is heated by the narrow width conductor 23, accordingly, a temperature of the concave portion 14 does not excessively decrease before arriving at the cooling section 22.

In the above embodiment, the heating conductor is provided with the narrow width conductor 23 and the wide width conductor 24. However, not limited to the above, the narrow width conductor 23 can be omitted and only the wide width conductor 24 is provided when the work 10 does not have the concave portion 14 or only whole the side portion 11 of the work 10 is heated.

In addition, although a pair of heating conductors is used in the above embodiment, others can be applied to the present invention, e.g., a heating coil connecting three or more heating conductors by a plurality of connecting conductors; a heating coil connecting a plurality of heating conductors by three or more connecting conductors. When using three or more connecting conductors, it is preferable to connect respective heating conductors with the connecting conductor so that current flows as even as possible at the connected portion.

The above embodiment is structured to move the long work 10 at a constant speed by the feeding machine and to perform an even induction heating by the heat treatment apparatus 20. However, not limited to the above, it is possible to perform an even induction heating on the whole work 10 along the longitudinal direction at rest by providing a heating conductor with a corresponding length to the work 10 arranged in a longitudinal direction. It enables an even induction heating of the work 10 by the heat treatment apparatus 20 according to the embodiment of the present invention even if the work 10 is not a long member.

REFERENCE SIGNS LIST

10: Work
11: Side portion
12: Upper and lower face
13: Corner portion
14: Concave portion
20: Heat treatment apparatus
21: Heating coil
22: Cooling section
23: Narrow width conductor
24: Wide width conductor
25, 26: core
27: End conductor
28: Lead portion
28*a*: Contact plate
29: Connecting conductor
29*a*: Upper connecting conductor
29*b*: Lower connecting conductor
31: Inlet for cooling liquid
32: Outlet for cooling liquid

The invention claimed is:

1. A heating coil, comprising: at least a set of heating conductors, including a first heating conductor configured to extend lengthwise along a first side of an elongated work with a first conductive surface facing the first side of the work and a second heating conductor configured to extend lengthwise along a second side of the work opposite to said first side with a second conductive surface facing the second side of the work; and a connecting conductor forming a loop, including a first connecting conductor portion that connects to in a first direction which is a longitudinal direction of the work and extends across one end of the first heating conductor that is perpendicular to the first side of the work and, a second connecting conductor portion that connects to in the first direction and extends across one end of the second heating conductor that is perpendicular to the second side of the work, wherein the first connecting conductor portion extends across the entire width of the one end of the first heating conductor in a direction parallel to the one end of the first heating conductor and extends further in said direction parallel to the end of the first heating conductor in upper and lower directions to upper and lower connecting portions of the connecting conductor, and wherein said second connecting conductor portion extends across the entire width of the one end of the second heating in a direction parallel to the one end of the second heating conductor and extends further in said direction parallel to the end of the second heating conductor in upper and lower directions to the upper and lower connecting portions of the connecting conductor, and wherein the other end of the first heating conductor is connected to one of a positive electrode and a negative electrode of a power supply, and the other end of the second heating conductor is connected to the other of the positive electrode and the negative electrode of the power supply, and wherein said first and second heating conductors each extend further upstream in said longitudinal direction along said first and second sides of said work, respectively, than said connecting conductor.

2. The heating coil according to claim 1, wherein each of the heating conductors faces the work partially, including at least the end connected with the connecting conductor.

3. The heating coil according to claim 2, wherein the connecting conductor is symmetrically arranged about the work.

4. The heating coil according to claim 1, wherein the connecting conductor is symmetrically arranged about the work.

5. The heating coil according to claim 1, wherein the work is a long member extending in one direction, wherein at least the first heating conductor and the second heating conductor partially face the work and are arranged in parallel to each other, and wherein the two connecting conductor portions are symmetrically arranged about the work.

6. The heating coil according to claim 1, wherein a cross-sectional area of conduction is greater at the connection between the first connecting conductor portion that connects to the end of the first heating conductor than at a narrowest portion of the first heating conductor, and a cross-sectional area of conduction is greater at the connection between the second connecting conductor portion that connects to the end of the second heating conductor than at a narrowest portion of the second heating conductor.

7. The heating coil according to claim 1, wherein the first connecting conductor portion connects to the end of the first heating conductor in a manner that conduction occurs through the entire end of the first heating conductor to said first connecting conductor portion, and the second connecting conductor portion connects to the end of the second heating conductor in a manner that conduction occurs through the entire end of the second heating conductor to said second connecting conductor portion.

8. The heating coil according to claim 1, wherein the first connecting conductor portion extends across the entire end of the first heating conductor in the direction parallel to the end of the first heating conductor and wherein said second connecting conductor portion extends across the entire end of the second heating conductor in the direction parallel to the end of the second heating conductor.

9. A heat treatment apparatus, comprising:

the heating coil according to claim 1;

a feeder that moves the work relative to the heating coil; and the power supply connected to a second end of the first heating conductor opposite to said end of the first heating conductor and to a second end of the second heating conductor opposite to said end of the second heating conductor.

10. The heat treatment apparatus according to claim 9, wherein the work moves at a predetermined speed in one direction during heating.

11. A heat treatment apparatus, comprising:

the heating coil according to claim 2;

a feeder that moves the work relative to the heating coil; and the power supply connected to an end of the first heating conductor opposite to said end of the first heating conductor and to an end of the second heating conductor opposite to said end of the second heating conductor.

12. A heat treatment apparatus, comprising:

the heating coil according to claim 4;

a feeder that moves the work relative to the heating coil; and the power supply connected to an end of the first heating conductor opposite to said end of the first heating conductor and to an end of the second heating conductor opposite to said end of the second heating conductor.

13. A heat treatment apparatus, comprising:

the heating coil according to claim 3;

a feeder that moves the work relative to the heating coil; and the power supply connected to an end of the first heating conductor opposite to said end of the first heating conductor and to an end of the second heating conductor opposite to said end of the second heating conductor.

14. A heat treatment apparatus, comprising:

the heating coil according to claim 5;

a feeder that moves the work relative to the heating coil; and the power supply connected to an end of the first heating conductor opposite to said end of the first heating conductor and to an end of the second heating conductor opposite to said end of the second heating conductor.

15. A heating coil, comprising:

a plurality of heating conductors disposed along each of two opposite sides so as to sandwich in a third direction an elongated work extending in a first direction and to heat a part of each of the opposite sides of the work;

a connecting conductor that connects first ends of the plurality of heating conductors along each of the opposite sides to each other, wherein the plurality of heating conductors along each of the opposite sides includes a narrow conductor and a wide conductor, and each of the plurality of heating conductors are arranged in parallel with each other along said first direction of the work, wherein each respective wide conductor is wider than the respective narrow conductor in a second direction perpendicular to said first direction that extends along a respective side face of the elongated work, wherein the connecting conductor is provided in parallel and is directly in contact with first end portions of each of the wide conductors parallel to each other, and is arranged to extend from an end of each of the plurality of heating conductors, with each wide conductor provided at the respective side of the work, in different directions from each other, wherein the third direction is orthogonal to the first direction and the second direction, and wherein each said narrow conductor extends further upstream in the first direction along the respective side of the work than the respective wide conductor.

16. A heat treatment apparatus, comprising:

the heating coil according to claim 15;

a feeder that moves the work relative to the heating coil; and a power supply connected with the other end of each of the heating conductors.

17. The heat treatment apparatus according to claim 16, wherein the work moves at the predetermined speed in one direction during heating.

* * * * *